US010393402B2

(12) United States Patent
Horng et al.

(10) Patent No.: US 10,393,402 B2
(45) Date of Patent: Aug. 27, 2019

(54) AIR EXCHANGE DEVICE AND COVERING MEMBER THEROF

(71) Applicant: Sunonwealth Electric Machine Industry Co., Ltd., Kaohsiung (TW)

(72) Inventors: Alex Horng, Kaohsiung (TW); Chun Ko, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 566 days.

(21) Appl. No.: 15/145,847

(22) Filed: May 4, 2016

(65) Prior Publication Data

US 2016/0348941 A1 Dec. 1, 2016

(30) Foreign Application Priority Data

May 28, 2015 (TW) ..... 104117183 A

(51) Int. Cl.
*F24F 13/20* (2006.01)
*F24F 7/08* (2006.01)
*F24F 13/08* (2006.01)

(52) U.S. Cl.
CPC ..... *F24F 13/20* (2013.01); *F24F 7/08* (2013.01); *F24F 13/082* (2013.01); *F24F 2221/17* (2013.01); *F24F 2221/52* (2013.01)

(58) Field of Classification Search
CPC .. F24F 13/20; F24F 13/082; F24F 7/08; F24F 2221/17; F24F 2221/52
USPC ..... 454/252
See application file for complete search history.

(56) References Cited

U.S. PATENT DOCUMENTS 5,000,081 A * 3/1991 Gilmer ..... F24F 7/08 165/54
5,435,377 A * 7/1995 Kratochvil ..... D06F 58/20 165/154
6,149,698 A * 11/2000 Uehara ..... F24F 7/013 454/351
6,241,600 B1 * 6/2001 Uehara ..... F24F 7/013 454/235
6,386,972 B1 * 5/2002 Schiedegger ..... F24F 7/02 454/358

(Continued)

FOREIGN PATENT DOCUMENTS

CN 203550108 U 4/2014
CN 203907874 U 10/2014

(Continued)

*Primary Examiner* — Vivek K Shirsat
*Assistant Examiner* — Ryan L Faulkner
(74) *Attorney, Agent, or Firm* — Alan D. Kamrath; Mayer & Williams

(57) ABSTRACT

An air exchange device improves the covering effect and the overall visual effect on the appearance of the air exchange device along with a divider where the air exchange device is mounted. The air exchange device includes an air-guiding tube and a covering member. The air-guiding tube has a first maximal outer diameter, and includes a first end and a second end. The covering member includes a positioning portion that is adapted to be coupled to an outer wall of the air-guiding tube, and a covering portion connected to the positioning portion. The covering portion has a second maximal outer diameter larger than the first maximal outer diameter of the air-guiding tube.

29 Claims, 7 Drawing Sheets

(56) References Cited

U.S. PATENT DOCUMENTS 6,776,704 B2 * 8/2004 Goncalves ..... F23L 17/04 126/85 B
7,549,258 B2 * 6/2009 Lajewski ..... F24F 13/084 439/544
7,610,726 B2 * 11/2009 Lajewski ..... F24F 7/00 248/220.21
7,930,858 B2 4/2011 Lajewski
8,240,093 B2 8/2012 Lajewski
8,702,483 B2 * 4/2014 Weng ..... F24F 13/02 454/237
8,888,574 B2 * 11/2014 Bredahl ..... F24F 13/082 454/271
2005/0202778 A1 * 9/2005 Stravitz ..... F24F 13/1413 454/353
2010/0081370 A1 * 4/2010 Weng ..... F24F 13/02 454/249
2010/0132287 A1 * 6/2010 Gaudreau ..... F24F 13/082 52/302.1
2010/0159821 A1 * 6/2010 Bredahl ..... F24F 13/082 454/358
2011/0059686 A1 * 3/2011 Hwang ..... F24F 7/06 454/245
2011/0232205 A1 9/2011 Lajewski
2012/0238200 A1 * 9/2012 Berkovitz ..... F24F 13/082 454/367
2013/0090053 A1 * 4/2013 Yokoyama ..... F24F 7/02 454/367
2013/0231042 A1 * 9/2013 Coscarella ..... F24F 13/082 454/339
2015/0087222 A1 * 3/2015 Li ..... F24F 7/007 454/338
2016/0051922 A1 * 2/2016 Horng ..... B01D 46/0005 55/471
2016/0084518 A1 * 3/2016 Horng ..... F24F 7/08 165/54

FOREIGN PATENT DOCUMENTS

CN 204141788 U 2/2015
TW M406160 U 6/2011
TW 201512611 A 4/2015
WO WO2011148646 A1 12/2011

* cited by examiner

AIR EXCHANGE DEVICE AND COVERING MEMBER THEROF

CROSS REFERENCE TO RELATED APPLICATIONS

The application claims the benefit of Taiwan application serial No. 104117183, filed on May 28, 2015, the subject matter of which is incorporated herein by reference.

BACKGROUND OF THE INVENTION

1. Field of the Invention

The present invention generally relates to an air exchange device and a covering member thereof and, more particularly, to an air exchange device with a ventilation function and having a covering member that prevents foreign debris from passing through a divider where the device is mounted.

2. Description of the Related Art

Please refer to FIG. 1, a conventional air exchange device 9 includes an air-guiding tube 91, a partition 92 and two fans 93. The partition 92 is arranged inside the air-guiding tube 91 and separates the air-guiding tube 91 into first and second air-guiding spaces 91*a* and 91*b*. The two fans 93 are arranged in the first and second air-guiding spaces 91*a* and 91*b*, respectively. The air exchange device 9 is adapted to be arranged in an installation hole D1 of a partitioning object "D" (e.g. a wall of a building), such that two opposite ends 911 and 912 of the air-guiding tube 91 are respectively received in external and internal spaces S1 and S2 at two opposite sides of the partitioning object "D."

In addition, the end 912 of the air-guiding tube 91 received in the internal space S2 can be connected to an indoor unit 94 having first and second receiving rooms 941 and 942 separately formed therein. The first and second receiving rooms 941 and 942 respectively intercommunicate with the first and second air-guiding spaces 91*a* and 91*b*, and the indoor unit 94 further includes an outlet 943 and an inlet 944 respectively intercommunicating with the first and second receiving rooms 941 and 942. Due to this arrangement, the fan 93 in the first air-guiding space 91*a* draws air from the external space S1 into the internal space S2 via the outlet 943, and the fan 93 in the second air-guiding space 91*b* draws air from the internal space S2 into the external space S1 via the inlet 944 for ventilation purposes. Such a conventional air exchange device 9 can be seen in China Patent Nos. 203550108 and 203907874.

However, since the installation hole D1 has a diameter larger than an outer diameter of the air-guiding tube 91, it is irreversible that a gap will be formed between the wall of the installation hole D1 and the outer periphery of the air-guiding tube 91 if it is required to install the air exchange device 9 into the installation hole D1 in a smooth manner (as shown in FIG. 1). In the external space S1, the existence of the gap may adversely affect the overall visual effect on the appearance of the air exchange device 9 along with the divider "D." In addition, foreign debris of the external space S1 such as water, dust or insects, is apt to enter the internal space S2 via the gap. Consequently, the air exchange device 9 may not be able to provide an excellent covering effect.

SUMMARY OF THE INVENTION

The term "divider" used hereinafter in the present invention represents any structure capable of separating a space into an external space and an internal space and having an installation hole for installation of an air exchange device.

For example, when a wall of a building serves as the divider, the external space is a space outside the building (i.e. outdoor space), and the internal space is a space inside the building (i.e. indoor space).

It is therefore the objective of this invention to provide an air exchange device and a covering member thereof which covers a gap between an installation hole and an air exchange device.

When the air exchange device and the covering member of the present invention is in use, the covering member can sufficiently prevent foreign debris such as water, dust and insects from entering the internal space.

The present invention provides an air exchange device including an air-guiding tube and a covering member. The air-guiding tube has a first maximal outer diameter, and includes a first end and a second end. The covering member includes a positioning portion that is adapted to be coupled to an outer wall of the air-guiding tube, and a covering portion connected to the positioning portion. The covering portion has a second maximal outer diameter larger than the first maximal outer diameter of the air-guiding tube.

In a form shown, the covering portion of the covering member radially extends from the positioning portion.

In the form shown, the covering portion of the covering member is a ring-shaped plate.

In the form shown, the positioning portion of the covering member is a positioning hole.

In the form shown, the covering member has a surface facing the first end of the air-guiding tube. A water-guiding rib is formed on the surface of the covering member.

In the form shown, the water-guiding rib is located on a lower part of the covering member and is adjacent to an outer edge of the covering member.

In the form shown, an engaging ring is formed on a periphery of the positioning portion and is adapted to engage with the outer wall of the air-guiding tube.

In the form shown, a guiding face is formed on an inner wall of the engaging ring.

In another form shown, an inclined face is formed on an inner wall of the engaging ring.

In the other form shown, the inclined face extends from the first end towards the second end of the air-guiding tube in an inclined and upward way.

In the other form shown, the covering member includes a reference line. An angle between an axial direction of the inclined face and the reference line is set at 0.4°-4°. Preferably, the angle is set at 0.4°-2°.

In the other form shown, the engaging ring of the covering member includes a water outlet.

In the form shown, the covering member has a surface facing the first end of the air-guiding tube. A rain shade is coupled to the surface of the covering member. Preferably, the rain shade is located on an upper part of the covering member.

In the form shown, at least one fan is arranged in the air-guiding tube between the first end and the second end.

In the form shown, the covering portion of the covering member includes a plurality of fastening holes each adapted for a fastening member to extend through and engage with.

The air exchange device of the present invention covers the gap formed between the installation hole and the outer wall of the air-guiding tube by the covering member. In addition, the air exchange device prevents foreign debris such as water, dust or insects from entering the internal space via the gap, thus providing an excellent covering effect and improving the overall visual effect on the appearance of the air exchange device along with the divider.

BRIEF DESCRIPTION OF THE DRAWINGS

The present invention will become more fully understood from the detailed description given hereinafter and the accompanying drawings which are given by way of illustration only, and thus are not limitative of the present invention disclosure, and wherein.

Figure 1:
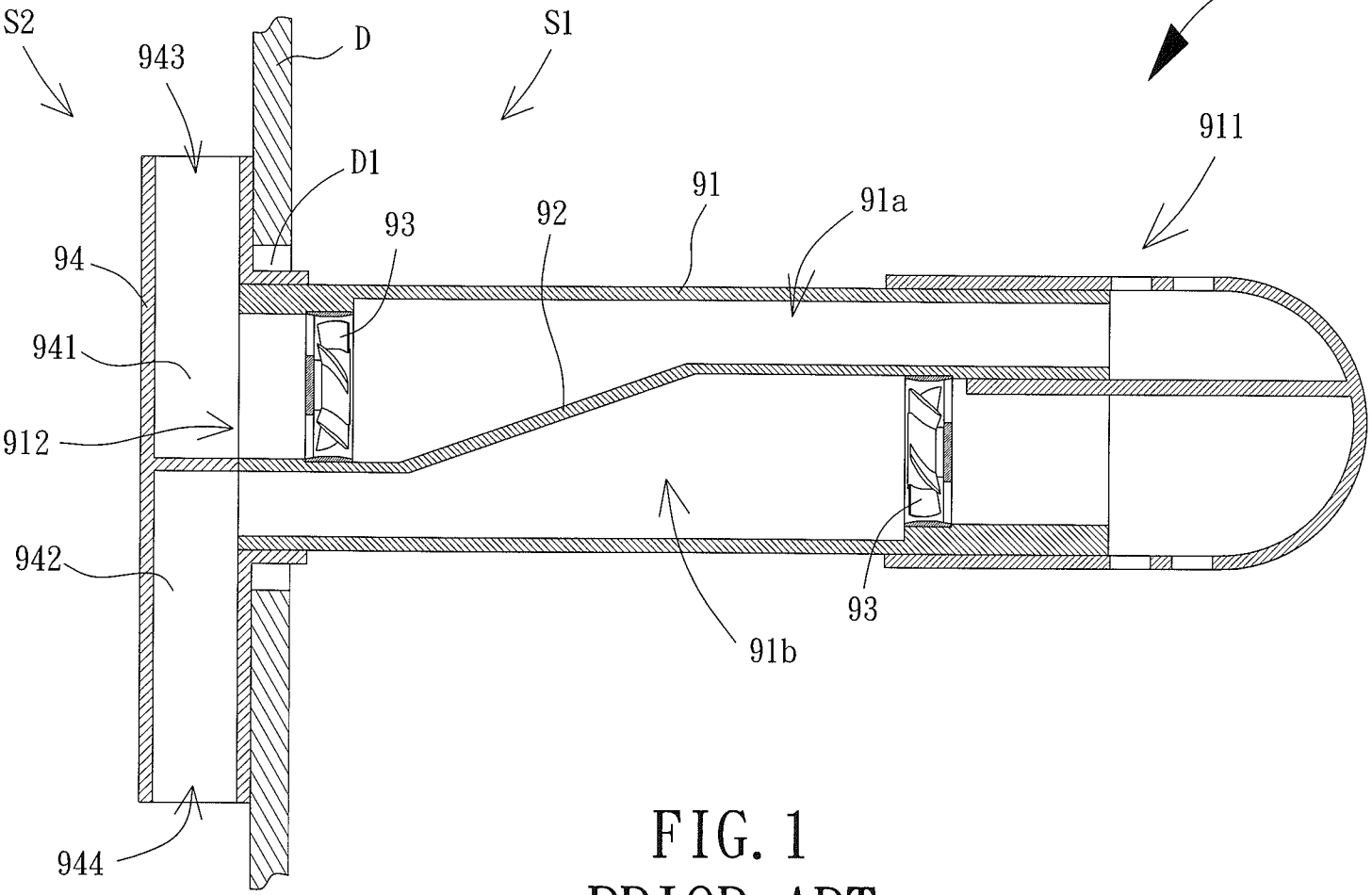
FIG. 1 PRIOR ART
FIG. 1 is a cross sectional view of a conventional air exchange device.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
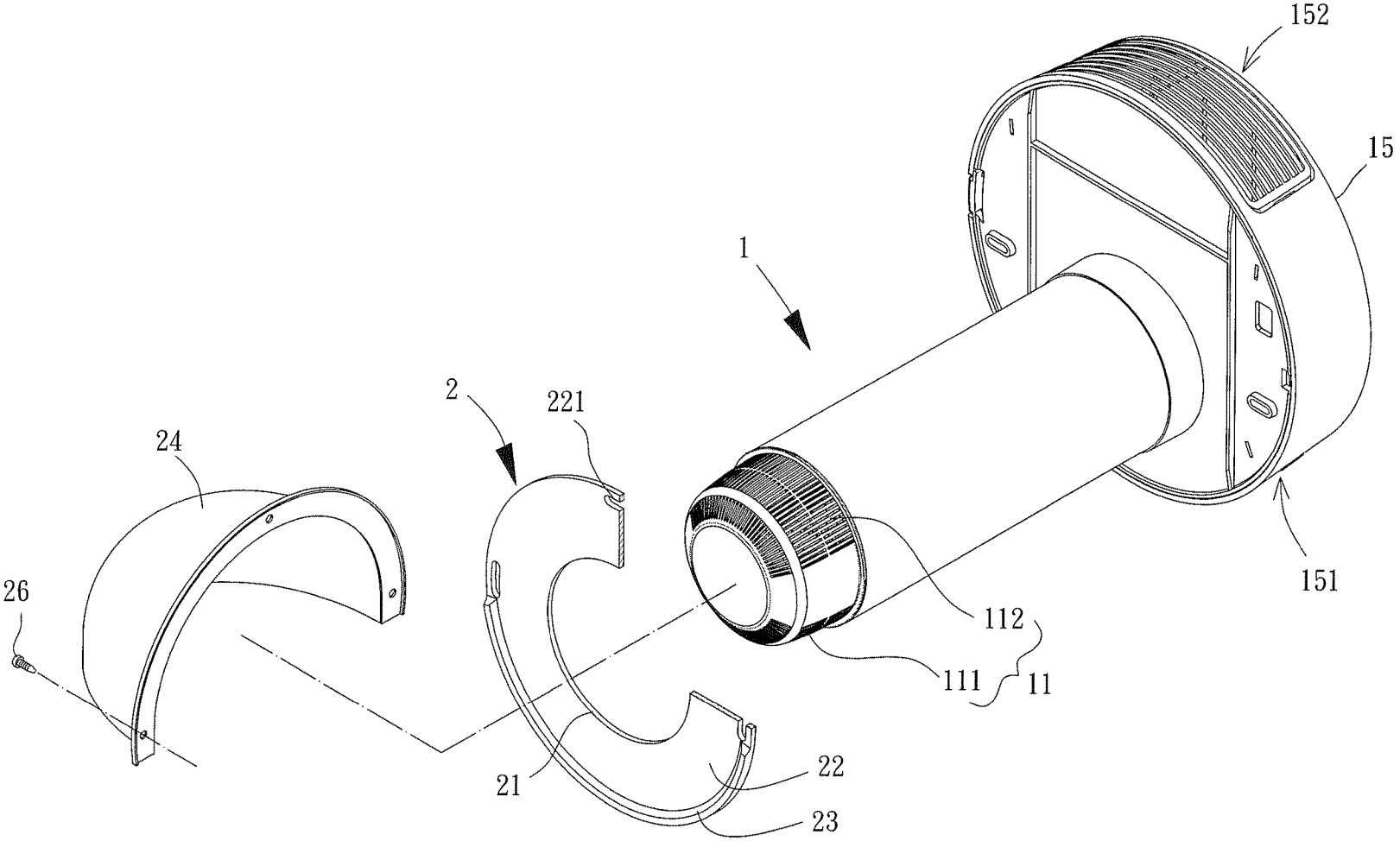
FIG. 2 is an exploded view of an air exchange device according to one implementation of the present invention.
Figure 3:
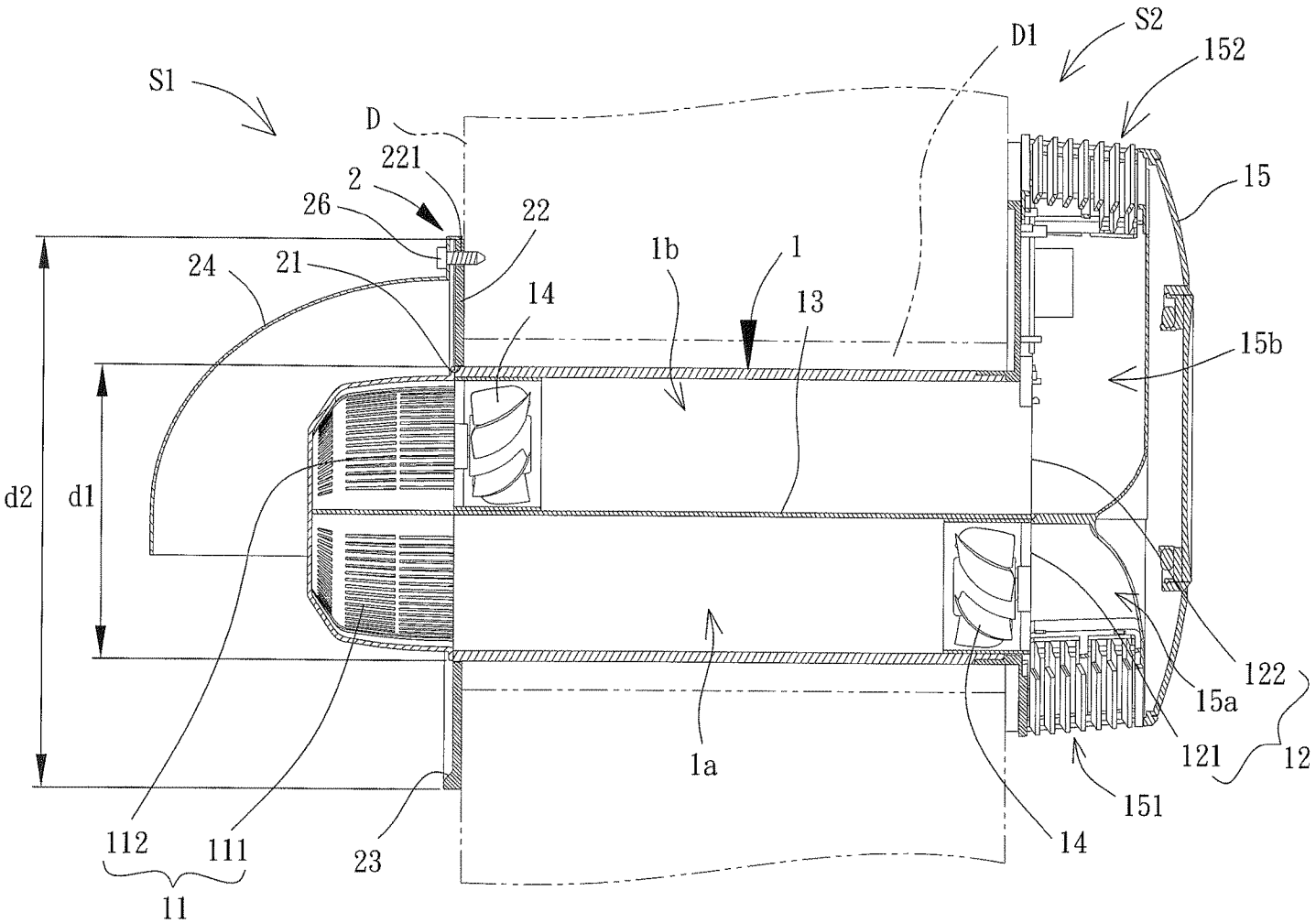
FIG. 3 is a cross sectional view of the air exchange device according to this implementation of the present invention where the air exchange device is installed in a wall.

Please refer to FIGS. 2 and 3, an air exchange device of the present invention is adapted to be installed in a divider "D" which defines an external space S1 at one side thereof, and an internal space S2 at an opposite side thereof. The air exchange device includes an air-guiding tube 1 and a covering member 2. The air-guiding tube 1 is installed in an installation hole D1 of the divider "D." The covering member 2 is coupled to an outer wall of the air-guiding tube 1, to cover the installation hole D1.

The air-guiding tube 1 has a first maximal outer diameter d1, and includes a first end 11 and a second end 12 opposite to the first end 11. The first and second ends 11 and 12 are respectively arranged in the external and internal spaces S1 and S2 for guiding the air. The air-guiding tube 1 is a hollow tube where air is able to pass therethrough, and the structure and appearance of the air-guiding tube 1 are not limited in the present invention. In this embodiment, the air-guiding tube 1 is a hollow, cylindrical tube. The first end 11 includes a first air-guiding opening 111 and a second air-guiding opening 112. Likewise, the second end 12 includes a third air-guiding opening 121 and a fourth air-guiding opening 122. A partition 13 is arranged in the air-guiding tube 1 and separates the air-guiding tube 1 into a first air-guiding space 1*a* and a second air-guiding space 1*b* independent from the first air-guiding space 1*a*. The first air-guiding space 1*a* intercommunicates with the first air-guiding opening 111 and the third air-guiding opening 121. The second air-guiding space 1*b* intercommunicates with the second air-guiding opening 112 and the fourth air-guiding opening 122. The partition 13 in the present invention is in the flat form. However, the partition 13 may also be in an arched or curved form but is not limited thereto.

At least one fan 14 can be arranged in at least one of the first and second air-guiding spaces 1*a* and 1*b* between the first and second ends 11 and 12. In this embodiment, a fan 14 is arranged in each of the first and second air-guiding spaces 1*a* and 1*b*, to improve the ventilation efficiency of the air-exchange device.

The second end 12 of the air-guiding tube 1 may further be connected to an indoor unit 15, with a first receiving room 15*a* and a second receiving room 15*b* separately formed inside the indoor unit 15 and independent from each other. The first receiving room 15*a* intercommunicates with the first air-guiding space 1*a* via the third air-guiding opening 121, and the second receiving room 15*b* intercommunicates with the second air-guiding space 1*b* via the fourth air-guiding opening 122. Furthermore, the indoor unit 15 includes an outlet 151 and an inlet 152, with the outlet 151 and the inlet 152 intercommunicating with the first and second receiving rooms 15*a* and 15*b*, respectively. In this arrangement, the indoor unit 15 and the air-guiding tube 1 jointly provide a desired ventilation effect. In addition, the indoor unit 15 may further include a control module arranged in the first receiving room 15*a* or the second receiving room 15*b*. The control module is electrically connected to the fan 14, driving the fan 14 to rotate. The indoor unit 15 is also able to cool the control module while the air is drawn therethrough, thus prolonging the service life of the control module. Moreover, since the indoor unit 15 is located in the internal space S2, the indoor unit 15 may also serve as a control panel of the air exchange device, thus improving the convenience of use.

Please refer to FIG. 3, based on the above structures of the air-guiding tube 1, when the fan 14 rotates, air is drawn into the first air-guiding space 1*a* through the first air-guiding opening 111. Then, the air flows into the internal space S2 through the third air-guiding opening 121, the first receiving room 15*a* and the outlet 151. Besides, the fan 14 draws the air into the second air-guiding space 1*b* through the inlet 152, the second receiving room 15*b* and the fourth air-guiding opening 122. Then, the air flows into the external space S1 through the second air-guiding opening 112. As such, the air circulates between the external and internal spaces S1 and S2, thus achieving an excellent ventilation effect.

The covering member 2 is coupled to the outer wall of the air-guiding tube 1 via a positioning portion 21. Accordingly, the positioning portion 21 may be any structure that can be engaged with the outer wall of the air-guiding tube 1, such as an engaging hole or a recess, which is not limited in the present invention. In this embodiment, the positioning portion 21 is a positioning hole and connects with a covering portion 22. Specifically, the covering portion 22 of the covering member 2 radially extends outwards from the positioning portion 21. Namely, the covering portion 22 is preferably a ring-shaped plate (e.g. a circular, oval, semi-circular or polygonal ring), and the positioning portion 21 is a positioning hole that is located substantially at the center of the ring-shaped plate. In addition, the covering portion 22 has a second maximal outer diameter d2 that is larger than the first maximal outer diameter d1 of the air-guiding tube 1.

Please refer to FIG. 3, due to the arrangement of the covering member 2, when the air-guiding tube 1 couples with the covering member 2 and is installed in the installation hole D1, the covering member 2 can further be coupled to a surface of the divider "D" facing the external space S1 by fastening, adhesion or engagement. Since the second maximal outer diameter d2 of the covering member 2 is larger than the first maximal outer diameter d1 of the air-guiding tube 1, the covering member 2 can cover a gap that is formed between the installation hole D1 and the outer wall of the air-guiding 1 on the surface of the divider "D." In this way, the covering member 2 provides both the covering and aesthetic functions, and also improves the overall visual effect on the appearance of the air exchange device along with the divider "D." Moreover, the covering member 2 also prevents foreign debris such as water, dust or insects from entering the internal space S2 via the gap, thus providing an excellent covering effect.

Please refer to FIGS. 2 and 3 again, the covering member 2 has a surface facing the first end 11 of the air-guiding tube 1. The surface of the covering member 2 may include a water-guiding rib 23 which preferably is located on a lower part of the covering member 2 (according to the orientation of the covering member 2 shown in FIG. 2) and is adjacent to an outer edge of the covering member 2. In this arrangement, when rain or water drops on the covering member 2 in the external space S1, the rain or water will flow to the water-guiding rib 23 along the surface of the covering member 2. In this regard, the water-guiding rib 23 is able to guide the rain or water off the covering member 2 without having the rain or water penetrated into a gap between the lower part of the covering portion 22 and the surface of the divider "D."

As shown in FIGS. 2 and 3, a rain shade 24 may be mounted to the surface of the covering member 2. The rain shade 24 is preferably located on an upper part of the covering member 2 (according to the orientation of the covering member 2 shown in FIG. 3). As such, the rain shade 24 is able to prevent the covering member 2 from exposing to a large amount of rain or water, thus providing an excellent shading effect for the covering member 2.

Figure 4:
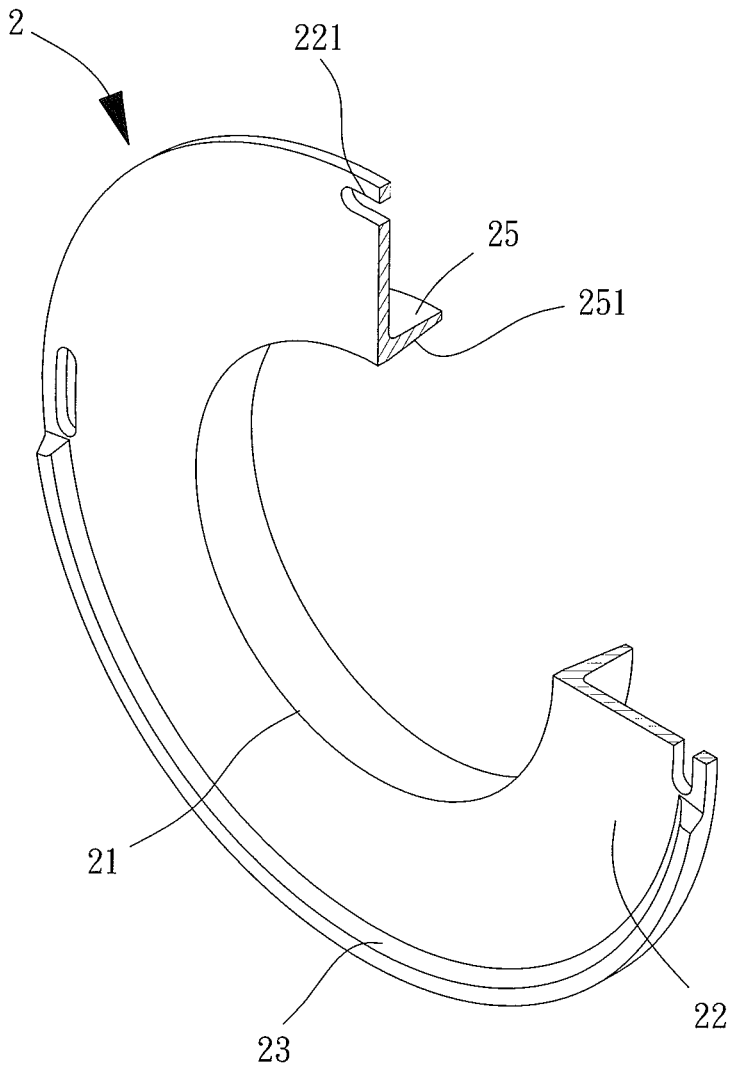
FIG. 4 is a perspective view of a covering member of an air exchange device according to another implementation of the present invention.
Figure 5:
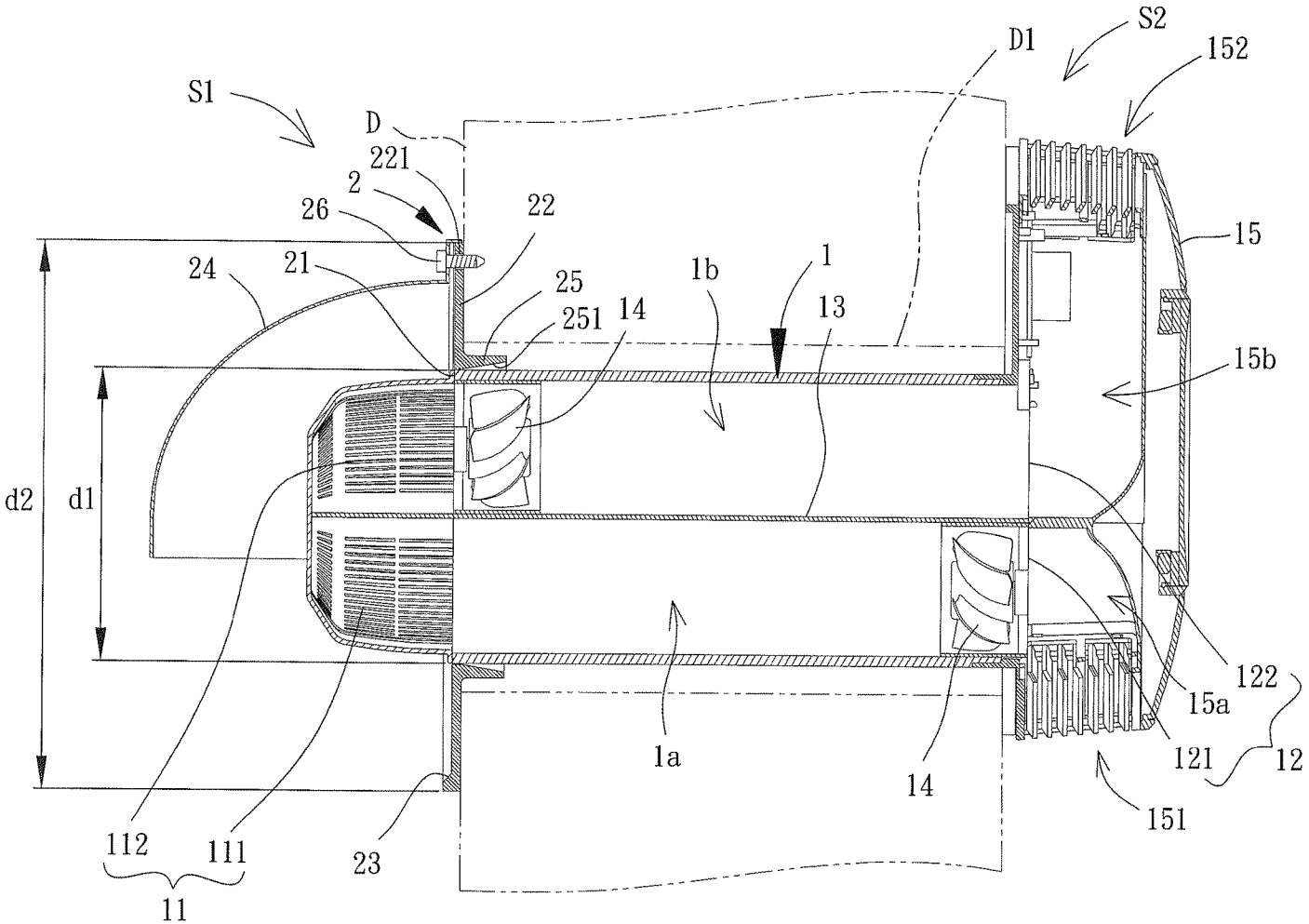
FIG. 5 is a cross sectional view of an air exchange device according to another implementation of the present invention where the air exchange device is installed in a wall.

Please refer to FIGS. 4 and 5, the covering member 2 further includes an engaging ring 25 formed on a periphery of the positioning portion 21. The engaging ring 25 extends towards the second end 12 of the air-guiding tube 1 and engages with the outer wall of the air-guiding tube 1. As such, the engagement between the covering member 2 and the air-guiding tube 1 is further enhanced. Moreover, the engaging ring 25 further includes a guiding face 251 on an inner wall thereof. The guiding face 251 defines a through hole. The through hole is tapered from the second end 12 towards the first end 11 of the air-guiding tube 1. Due to the arrangement of the guiding face 251, the air-guiding tube 1 can be inserted into the positioning hole of the positioning portion 21 of the covering member 2 in a smooth manner, thus providing a convenient assembly.

Please refer to FIGS. 2 and 3 again, a plurality of fastening holes 221 may be arranged on the covering portion 22 of the covering member 2. Each fastening hole 221 is adapted for a fastening member 26 to extend through and engage with, such that the covering member 2 can be securely engaged with the surface of the divider "D." The fastening hole 221 may be any form that is suitable for the fastening member 26 to extend therethrough. In this embodiment, the fastening hole 221 is an elongated hole (e.g. an oval hole), such that the user is able to slightly adjust the position of the fastening member 26 when the fastening member 26 extends through the fastening hole 221. As such, the fastening member 26 can be easily engaged with the surface of the divider "D," thus improving the convenience in assembly.

Figure 6:
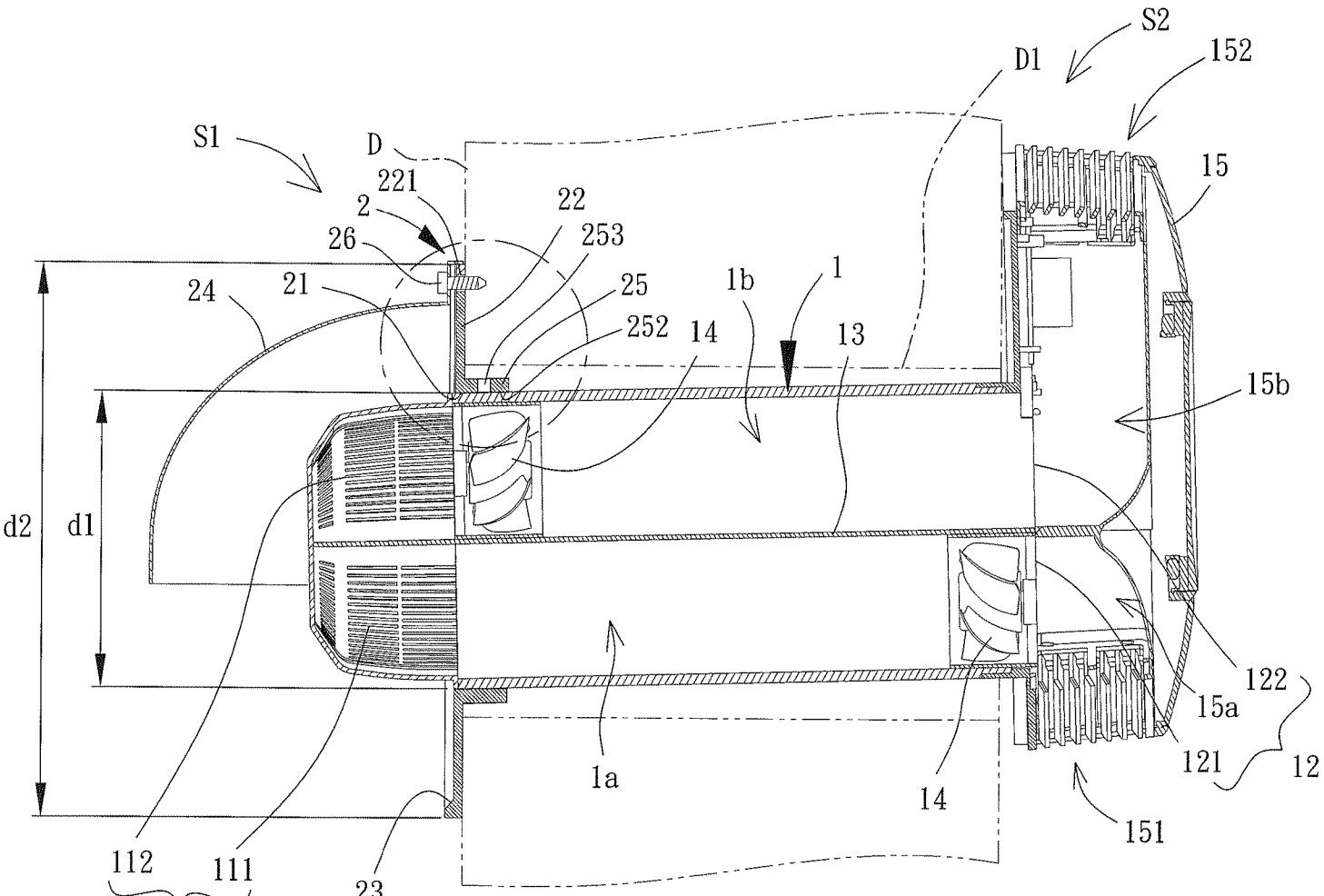
FIG. 6 is a cross sectional view of the air exchange device of the present invention where the air exchange device is installed in a wall in an inclined manner.
Figure 7:
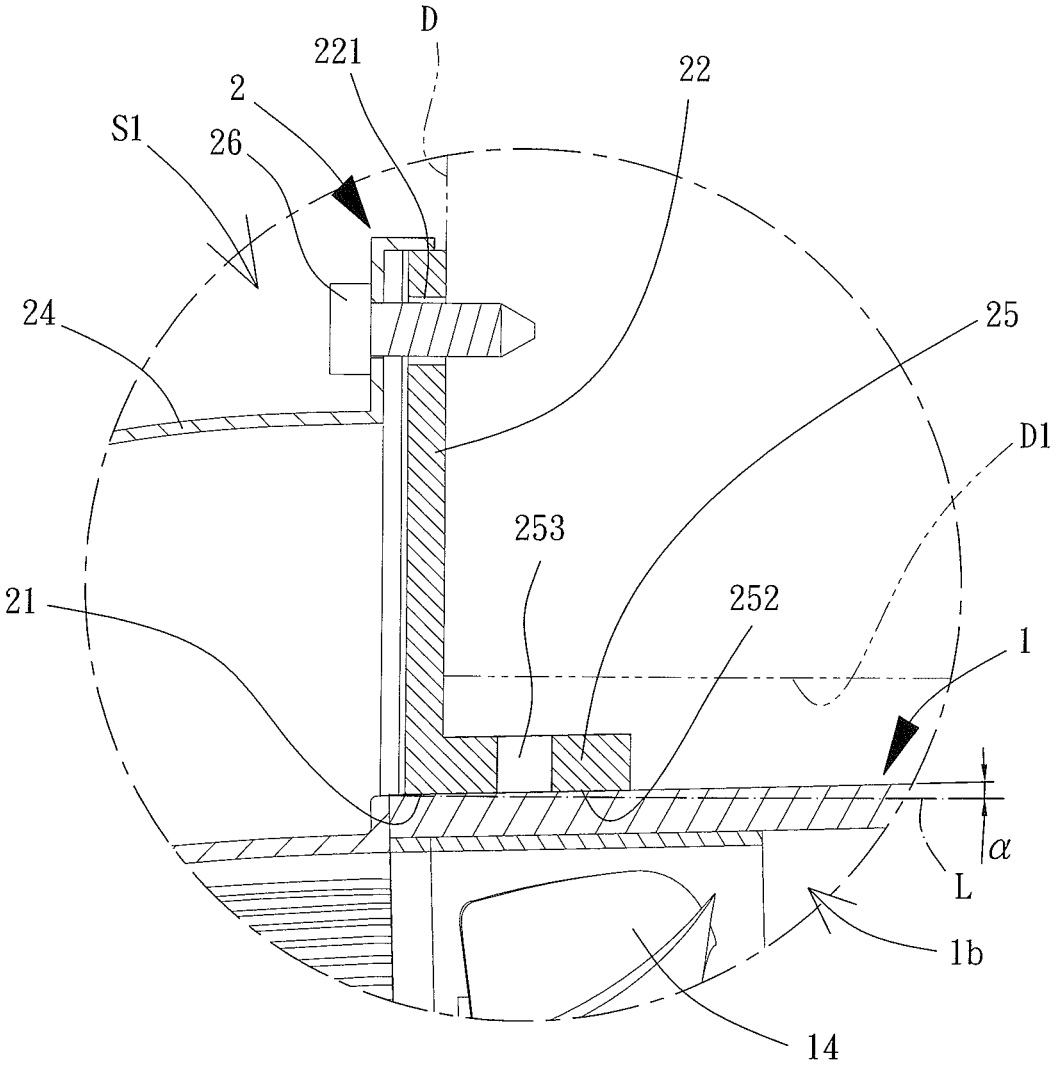
FIG. 7 is a partially-enlarged cross sectional view of the air exchange device shown in FIG. 6.

Instead of the guiding face 251 shown in FIGS. 4 and 5, an inclined face 252 may be formed on the inner wall of the engaging ring 25 as shown in FIGS. 6 and 7. The inclined face 252 extends from the first end 11 towards the second end 12 in an inclined and upward way, such that the first end 11 is lower than the second end 12 when the air-guiding tube 1 is engaged with the covering member 2 and installed in the installation hole D1 (according to the orientation of the air-guiding tube 1 shown in FIG. 6). The covering member 2 has a reference line "L" (the reference line "L" is defined to extend in parallel to the axial direction of the installation hole D1). An angle $\alpha$ between an axial direction of the inclined face 252 and the reference line "L" is set at 0.4° to 4° and, preferably, 0.4° to 2°, to provide convenient installation of the air-guiding tube 1. In this arrangement, the air-guiding tube 1, which is installed in the installation hole D1, has the second end 12 higher than the first end 11. When rain or water drops on the covering member 2, the rain or water may flow into the installation hole D1 through a gap between the upper part of the covering portion 22 and the surface of the divider "D" and further attach to the outer wall of the air-guiding tube 1. In this regard, the air-guiding tube 1 inclined downwardly from the reference line "L" is able to guide the rain or water out of the installation hole D1. Preferably, the engaging ring 25 of the covering member 2 may further include a water outlet 253 in order to efficiently guide the rain or water out of the installation hole D1.

As a conclusion, the air exchange device of the present invention, which has the covering member 2 engaged with the outer wall of the air-guiding tube 1, covers the gap formed between the installation hole D1 and the outer wall of the air-guiding tube 1 by the covering member 2. Therefore, the air exchange device prevents foreign debris such as water, dust or insects from entering the internal space S2 via the gap. As a result, the covering member 2 provides an excellent covering effect and improves the overall visual effect on the appearance of the air exchange device along with the divider "D."

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An air exchange device, comprising:

an air-guiding tube having a first maximal outer diameter, wherein the air-guiding tube comprises a first end and a second end; and a covering member comprising a positioning portion adapted to be coupled to an outer wall of the air-guiding tube and a covering portion connected to the positioning portion, wherein the covering portion has a second maximal outer diameter larger than the first maximal outer diameter of the air-guiding tube, wherein an engaging ring is formed on a periphery of the positioning portion and engages with the outer wall of the air-guiding tube, wherein an inclined face is formed on an inner wall of the engaging ring, wherein the inclined face extends from the first end to a termination towards the second end of the air-guiding tube in an inclined and upward way, and wherein the inclined face is inclined in a same inclination direction and engages with the air-guiding tube from the first end to the termination.

2. The air exchange device as claimed in claim 1, wherein the covering portion of the covering member radially extends from the positioning portion.

3. The air exchange device as claimed in claim 2, wherein the covering portion of the covering member is a ring-shaped plate.

4. The air exchange device as claimed in claim 1, wherein the positioning portion of the covering member is a positioning hole.

5. The air exchange device as claimed in claim 1, wherein the covering member has a surface facing in a same direction in which the first end of the air-guiding tube is extending and terminating in an annular outer edge, and wherein a water-guiding rib is formed on the annular outer edge of the surface of the covering member and extends in the same direction from the surface.

6. The air exchange device as claimed in claim 5, wherein the water-guiding rib is C-shaped and is located solely on a lower part of the annular outer edge of the covering member.

7. The air exchange device as claimed in claim 1, wherein a guiding face is formed on an inner wall of the engaging ring.

8. The air exchange device as claimed in claim 1, wherein the covering member comprises a reference line, and wherein an angle between an axial direction of the inclined face and the reference line is set at 0.4°-4°.

9. The air exchange device as claimed in claim 1, wherein the covering member comprises a reference line, and wherein an angle between an axial direction of the inclined face and the reference line is set at 0.4°-2°.

10. The air exchange device as claimed in claim 1, wherein the engaging ring of the covering member comprises a water outlet.

11. The air exchange device as claimed in claim 1, wherein the covering member has a surface facing in a same direction in which the first end of the air-guiding tube is extending and terminating in an annular outer edge, and wherein a rain shade is coupled to the surface of the covering member.

12. The air exchange device as claimed in claim 11, wherein the rain shade is located on an upper part of the covering member.

13. The air exchange device as claimed in claim 1, wherein at least one fan is arranged in the air-guiding tube between the first end and the second end.

14. The air exchange device as claimed in claim 1, wherein the covering portion of the covering member comprises a plurality of fastening holes each adapted for a fastening member to extend through and engage with.

15. The air exchange device as claimed in claim 14, wherein the plurality of fastening holes are elongated holes.

16. A covering member of an air exchange device, comprising:

a positioning portion adapted to be coupled to an outer wall of an air-guiding tube, wherein an engaging ring is formed on a periphery of the positioning portion and is adapted to engage with the outer wall of the air-guiding tube, wherein an inclined face is formed on an inner wall of the engaging ring; and a covering portion connected to the positioning portion;

wherein the inclined face is inclined from a central axis of the covering portion, and wherein an entirety of the inclined face is inclined in a same inclination direction and is adapted to engage with the air-guiding tube.

17. The covering member of the air exchange device as claimed in claim 16, wherein the covering portion radially extends from the positioning portion.

18. The covering member of the air exchange device as claimed in claim 17, wherein the covering portion is a ring-shaped plate.

19. The covering member of the air exchange device as claimed in claim 16, wherein the positioning portion of the covering member is a positioning hole.

20. The covering member of the air exchange device as claimed in claim 16, wherein the covering member has a surface, and wherein a water-guiding rib is formed on the surface of the covering member.

21. The covering member of the air exchange device as claimed in claim 20, wherein the water-guiding rib is C-shaped and is located solely on a lower part of the covering member and is adjacent to an outer edge of the annular outer edge of the covering member.

22. The covering member of the air exchange device as claimed in claim 16, wherein a guiding face is formed on an inner wall of the engaging ring.

23. The covering member of the air exchange device as claimed in claim 16, wherein the covering member has a reference line, and where an angle between an axial direction of the inclined face and the reference line is set at 0.4°-4°.

24. The covering member of the air exchange device as claimed in claim 16, wherein the covering member has a reference line, and wherein an angle between an axial direction of the inclined face and the reference line is set at 0.4°-2°.

25. The covering member of the air exchange device as claimed in claim 16, wherein the engaging ring of the covering member comprises a water outlet.

26. The covering member of the air exchange device as claimed in claim 16, wherein a rain shade is coupled to a surface of the covering member.

27. The covering member of the air exchange device as claimed in claim 26, wherein the rain shade is located on an upper part of the covering member.

28. The a covering member of the air exchange device as claimed in claim 16, wherein the covering portion of the covering member comprises a plurality of fastening holes each adapted for a fastening member to extend through and engage with.

29. The covering member of the air exchange device as claimed in claim 28, wherein the plurality of fastening holes are elongated holes.

* * * * *